US010773538B2

(12) United States Patent
Shih

(10) Patent No.: US 10,773,538 B2
(45) Date of Patent: Sep. 15, 2020

(54) POSITIONING DEVICE FOR AN INK PAD CONTAINER

(71) Applicant: SUN SAME ENTERPRISES CO., LTD., Tainan (TW)

(72) Inventor: Wen-Jer Shih, Tainan (TW)

(73) Assignee: Sun Same Enterprises Co., Ltd., Tainan (TW)

( * ) Notice: Subject to any disclaimer, the term of this patent is extended or adjusted under 35 U.S.C. 154(b) by 206 days.

(21) Appl. No.: 16/120,924

(22) Filed: Sep. 4, 2018

(65) Prior Publication Data

US 2019/0270326 A1 Sep. 5, 2019

(30) Foreign Application Priority Data

Mar. 2, 2018 (TW) ..... 107202798 A

(51) Int. Cl.
*B41K 1/38* (2006.01)
*B41K 1/54* (2006.01)

(52) U.S. Cl.
CPC ..... *B41K 1/54* (2013.01)

(58) Field of Classification Search
CPC ... B41K 1/02; B41K 1/36; B41K 1/38; B41K 1/40; B41K 1/54
USPC ..... 101/103, 104, 109, 333, 334; D18/15
See application file for complete search history.

(56) References Cited

U.S. PATENT DOCUMENTS

2005/0145127 A1* 7/2005 Zindl ..... B41K 1/40 101/333
2006/0144267 A1* 7/2006 Moody ..... B41K 1/52 101/334
2008/0148975 A1* 6/2008 Faber ..... B41K 1/40 101/334
2014/0196622 A1* 7/2014 Shih ..... B41K 1/40 101/333

* cited by examiner

*Primary Examiner* — Leslie J Evanisko
(74) *Attorney, Agent, or Firm* — Alan D. Kamrath; Karin L. Williams; Mayer & Williams PC

(57) ABSTRACT

A positioning device for an ink pad container has a body and two elastic sheets. The two elastic sheets are respectively formed on two lateral side surfaces of the body. Each one of the two elastic sheets has an arm and a positioning protrusion. The arm is formed on a corresponding one of the two lateral side surfaces of the body, and is inserted into a corresponding one of two through grooves of the body. The positioning protrusion is formed on an inner side surface of the arm and is inserted into the body. An ink pad container may be firmly positioned into the body by the two elastic sheets. The tolerance allowances of the positioning device and the ink pad container are increased by the resiliences of the two elastic sheets. The positioning device can simultaneously satisfy the requirements for ease in assembly and for the positioning stability.

4 Claims, 10 Drawing Sheets

POSITIONING DEVICE FOR AN INK PAD CONTAINER

This application claims the benefit of Taiwan patent application No. 107202798, filed on Mar. 2, 2018, the entire contents of which are incorporated herein by reference.

BACKGROUND OF THE INVENTION

1. Field of the Invention

The present invention relates to a positioning device for an ink pad container, and more particularly to a positioning device that may improve the positioning stability of the ink pad container.

2. Description of Related Art

With reference to FIGS. 11 and 12, a conventional positioning device for an ink pad container has a body 90. The body 90 has a front surface, a rear surface, two side surfaces, a receiving space 91, a front opening 92, a rear opening 93, and two positioning protrusions 94. The receiving space 91 is formed in the body 90. The front opening 92 is formed on the front surface of the body 90 and communicates with the receiving space 91. The rear opening 93 is formed on the rear surface of the body 90 and communicates with the receiving space 91. The two positioning protrusions 94 are respectively formed on the two side surfaces of the body 90 and are inserted into the receiving space 91.

In use, the conventional positioning device can be disposed on a housing of a stamp for an ink pad container 80 to be inserted therein. The ink pad container 80 has two side surfaces. In each one of the two side surfaces of the ink pad container 80, two longitudinal ribs 81 are formed on and extend out of the side surface of the ink pad container 80 at a spaced interval. A positioning groove 82 is formed on the side surface of the ink pad container 80 and is located between the two longitudinal ribs 81. The ink pad container 80 can be inserted into the receiving space 91 of the body 90 via the front opening 92 or the rear opening 93. The positioning protrusions 94 are respectively inserted into the positioning grooves 82 of the ink pad container 80 to position the ink pad container 80 in the body 90.

Sizes and locations of the positioning protrusions 94 of the body 90 are fixed. Before each one of the two positioning protrusions 94 is inserted into a corresponding one of the positioning grooves 82, the positioning protrusion 94 has to pass through one of the two longitudinal ribs 81. After the positioning protrusion 94 is inserted into the corresponding positioning groove 82, a gap 70 is formed between the positioning protrusion 94 and the adjacent longitudinal ribs 81. The positioning protrusion 94 cannot abut against the adjacent longitudinal ribs 81. Therefore, the ink pad container 80 has a moveable allowance and cannot be steadily positioned in the body 90. The ink pad container 80 may be swayed to deviation. A printing surface of the stamp cannot be completely pressed on an ink pad 83 of the ink pad container 80. Ink stained on the printing surface is not distributed evenly, which also makes a stamped pattern unclear.

For increasing the positioning stability of the ink pad container 80, a protruding height of each one of the positioning protrusion 94 may be increased for firm abutment. Then, the ink pad container 80 is hard to be inserted into or pressed out of the body 90. Size settings of the ink pad container 80 and the body 90 can hardly simultaneously satisfy the requirements for ease in assembly and for the positioning stability.

To overcome the shortcomings, the present invention provides a positioning device for an ink pad container to mitigate or obviate the aforementioned problems.

SUMMARY OF THE INVENTION

The objective of the invention is to provide a positioning device for an ink pad container that can solve the shortcoming that the conventional positioning device cannot fix the ink pad container well, and cannot simultaneously satisfy the requirements for ease in assembly and for the positioning stability.

The positioning device for an ink pad container has a body and two elastic sheets. The body has a receiving space, a front side surface, a rear side surface, two lateral side surfaces, a front opening, a rear opening, and two through grooves. The receiving space is formed in the body. The lateral side surfaces are opposite to each other. The front opening is formed through the front side surface of the body and communicates with the receiving space. The rear opening is formed through the rear side surface of the body and communicates with the receiving space. The two through grooves are respectively formed through the two lateral side surfaces of the body and both communicate with the receiving space. The two elastic sheets are respectively formed on the two lateral side surfaces of the body. Each one of the two elastic sheets has an arm and a positioning protrusion. The arm is formed on a corresponding one of the two lateral side surfaces of the body, is inserted into a corresponding one of the two through grooves, and has an inner side surface. The positioning protrusion is formed on the inner side surface of the arm and is inserted into the receiving space of the body.

An ink pad container may be inserted into the receiving space of the positioning device via the front opening or the rear opening. The ink pad container has two outer surfaces and two positioning members. The outer surfaces are opposite to each other. The two positioning members are respectively disposed on the two outer surfaces of the ink pad container. Each one of the two positioning members has two longitudinal ribs and a positioning groove. The longitudinal ribs are formed on and protrude out of the outer surface of the ink pad container. The positioning groove is formed on the outer surface of the ink pad container and is located between the two longitudinal ribs.

When the ink pad container passes between the two elastic sheets, one of the two longitudinal ribs passes through the positioning protrusion of a corresponding one of the two elastic sheets and pushes the corresponding arm outwardly, and then the positioning protrusion is inserted into the positioning groove. The positioning protrusion is pressed by a resilience of the corresponding one of the two elastic sheets to abut the two longitudinal ribs. The positioning protrusion is in contact with the two longitudinal ribs for maintaining a positioning situation. After the ink pad container is inserted into the body for positioning, the ink pad container does not have a moveable allowance to move. Therefore, the ink pad container can be firmly positioned in the body, and the positioning stability of the ink pad container is increased. A printing surface of a stamp can be pressed on an ink pad in the ink pad container completely. Ink stained on the printing surface is distributed evenly, which also makes a stamped pattern clear. In addition, the tolerance allowances of the positioning device and the ink pad container are increased by the resiliences of the two elastic sheets. The ink pad container is firmly disposed in the positioning device. Therefore, the positioning device can simultaneously satisfy the requirements for ease in assembly and for the positioning stability.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
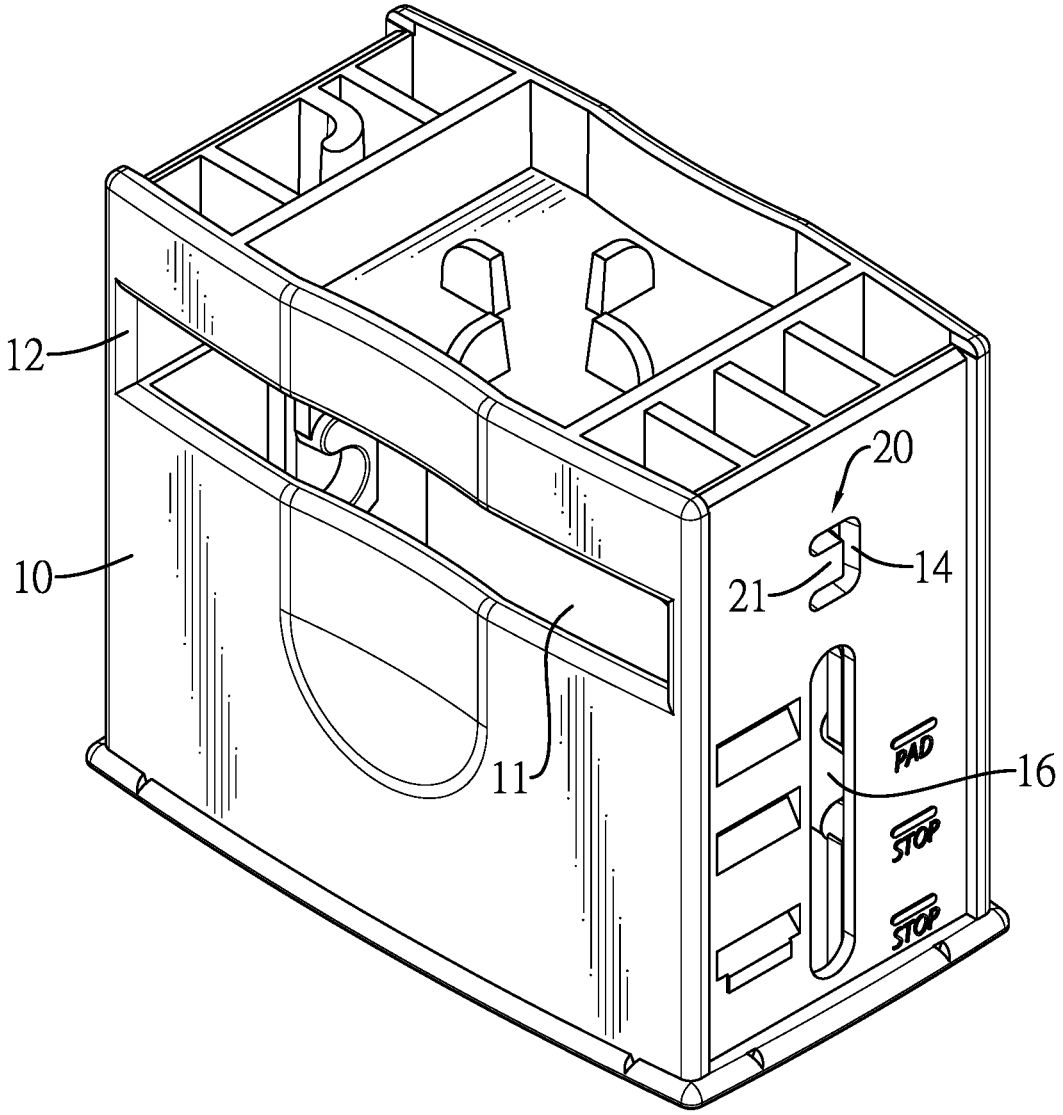
FIG. 1 is a perspective view of a positioning device for an ink pad container in accordance with the present invention.
Figure 2:
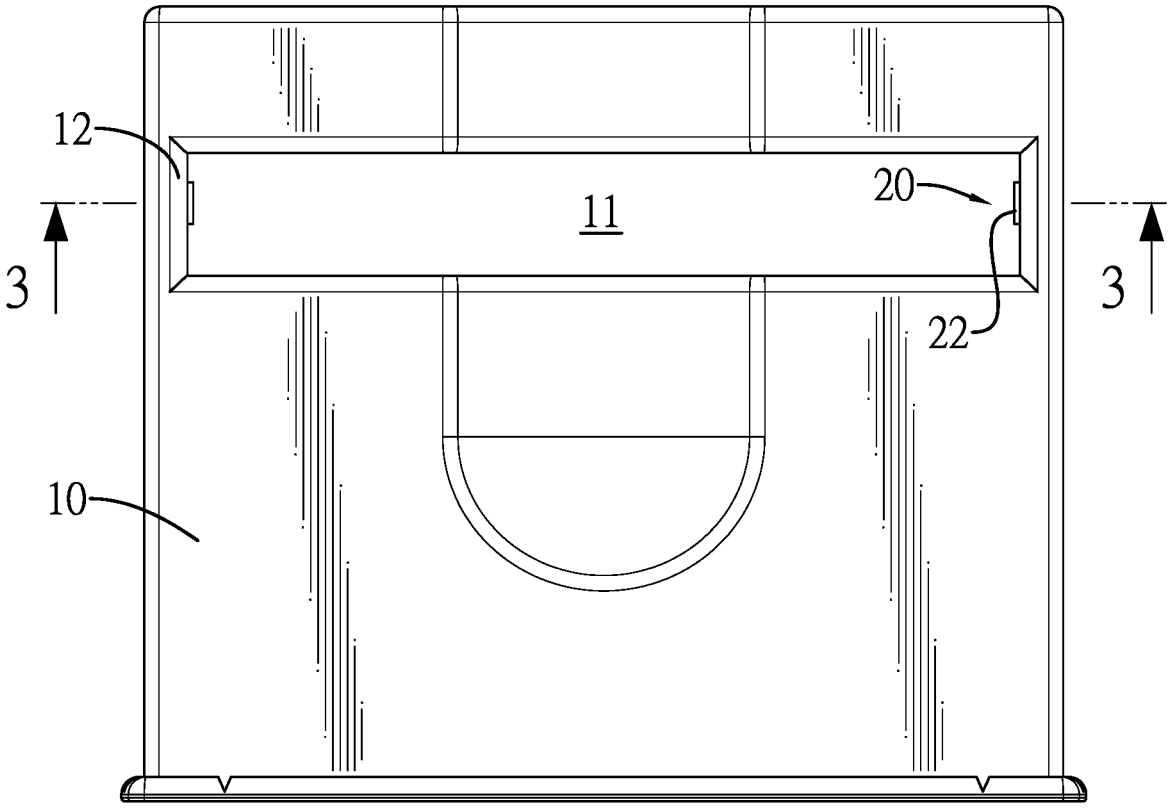
FIG. 2 is a front side view of the positioning device in FIG. 1.
Figure 3:
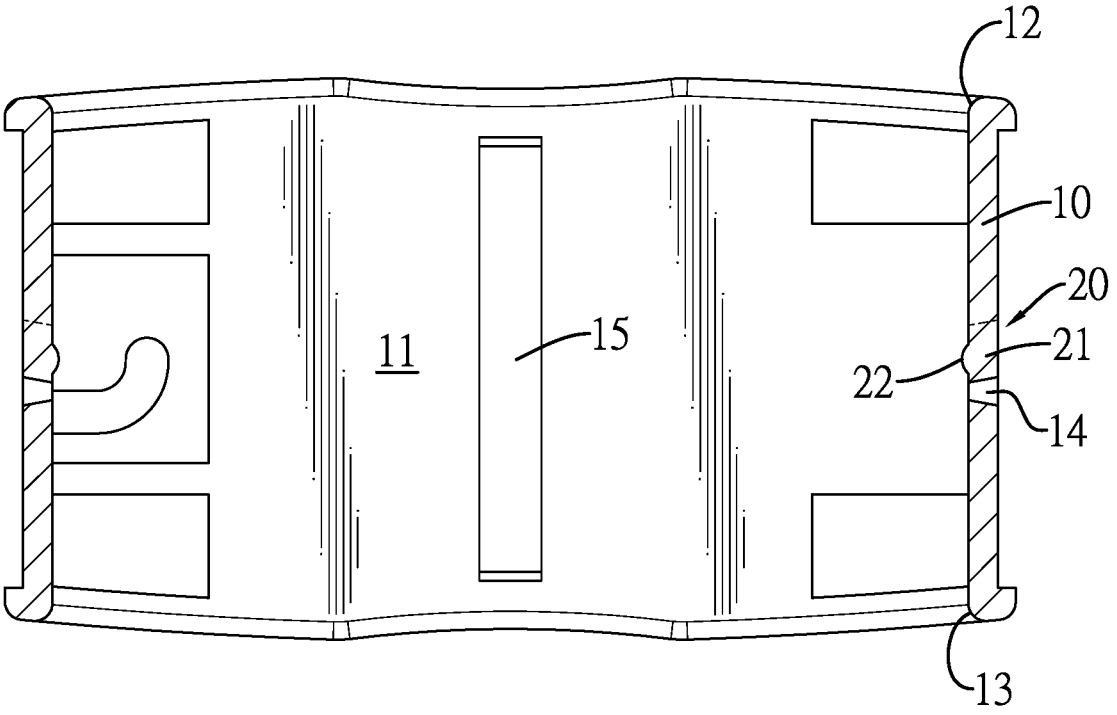
FIG. 3 is a cross sectional side view of the positioning device along line 3-3 in FIG. 2.
Figure 4:
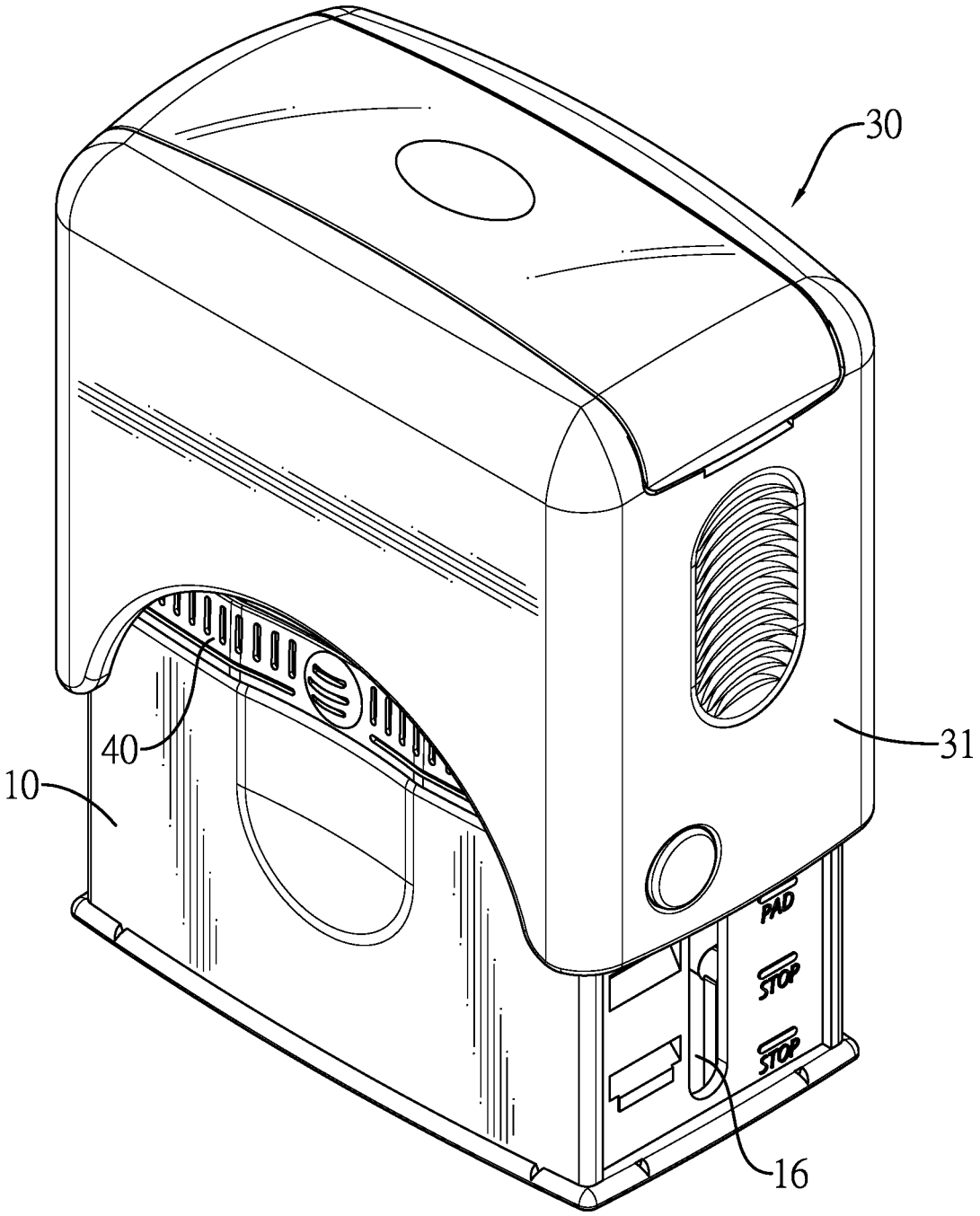
FIG. 4 is an operational perspective view of the positioning device in FIG. 1, showing the positioning device is disposed in a housing.
Figure 5:
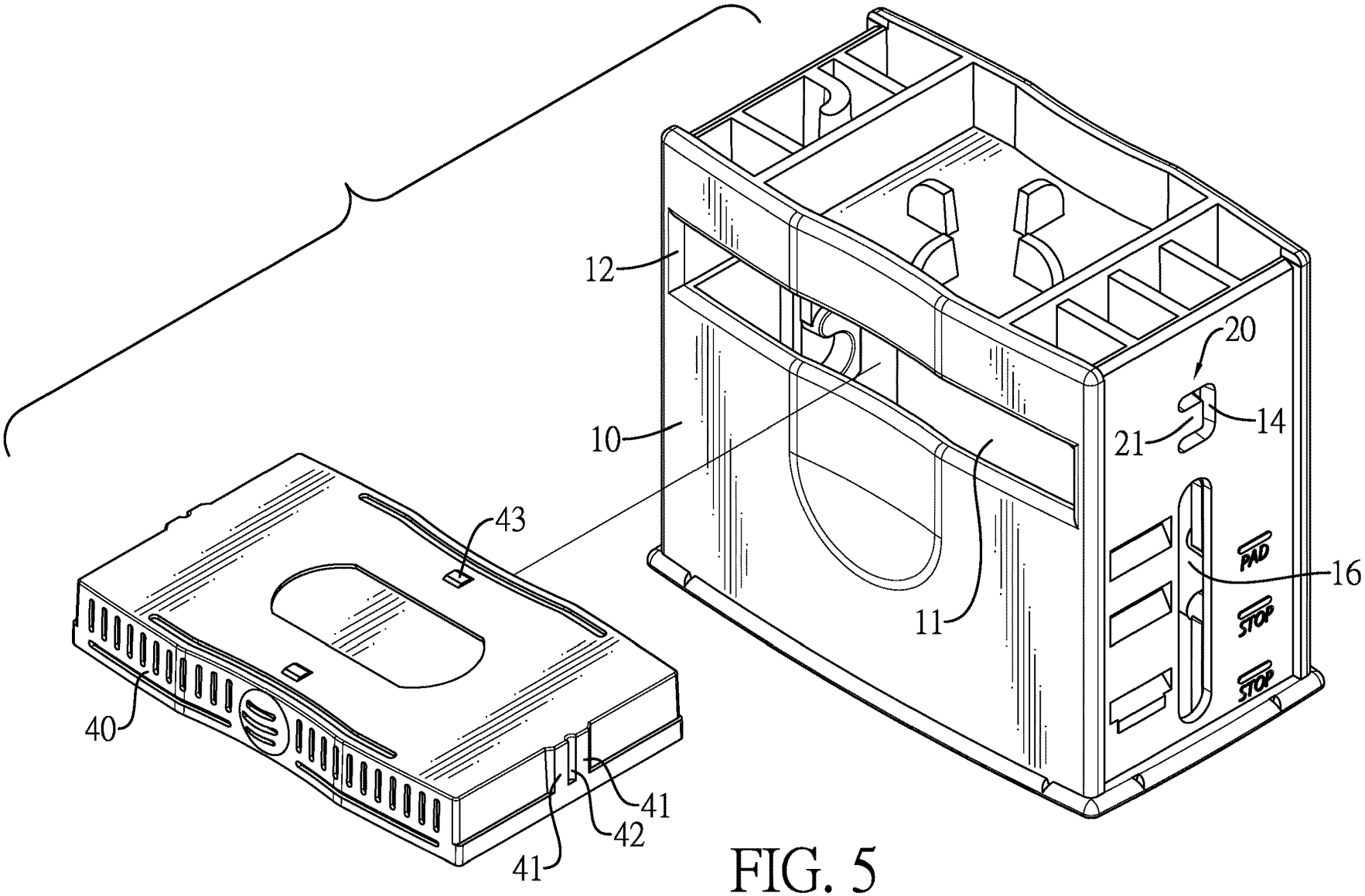
FIG. 5 is an exploded perspective view of the positioning device in FIG. 4, showing an ink pad container is not disposed into the positioning device yet.
Figure 6:
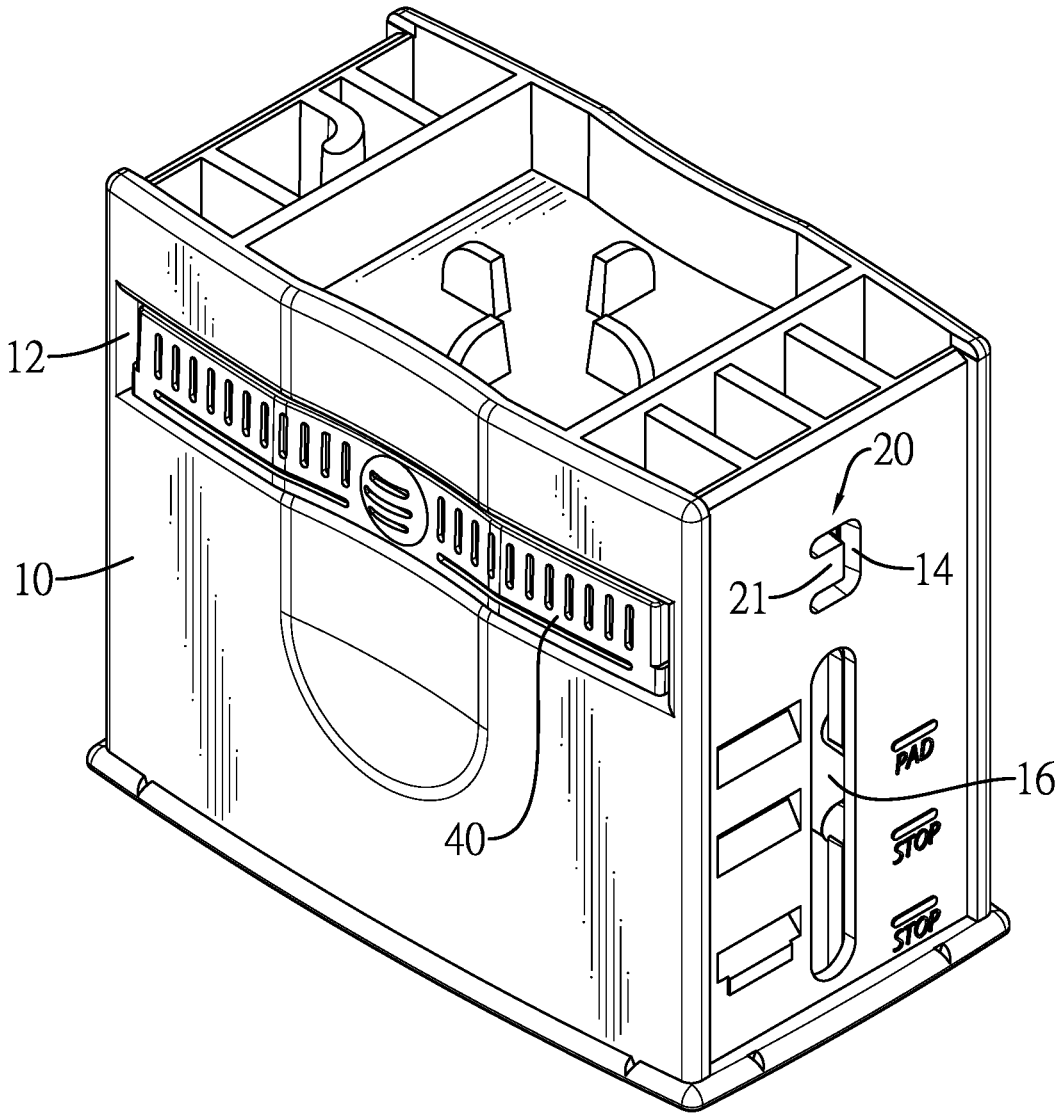
FIG. 6 is a perspective view of the positioning device in FIG. 4, showing the ink pad container is disposed into the positioning device.
Figure 7:
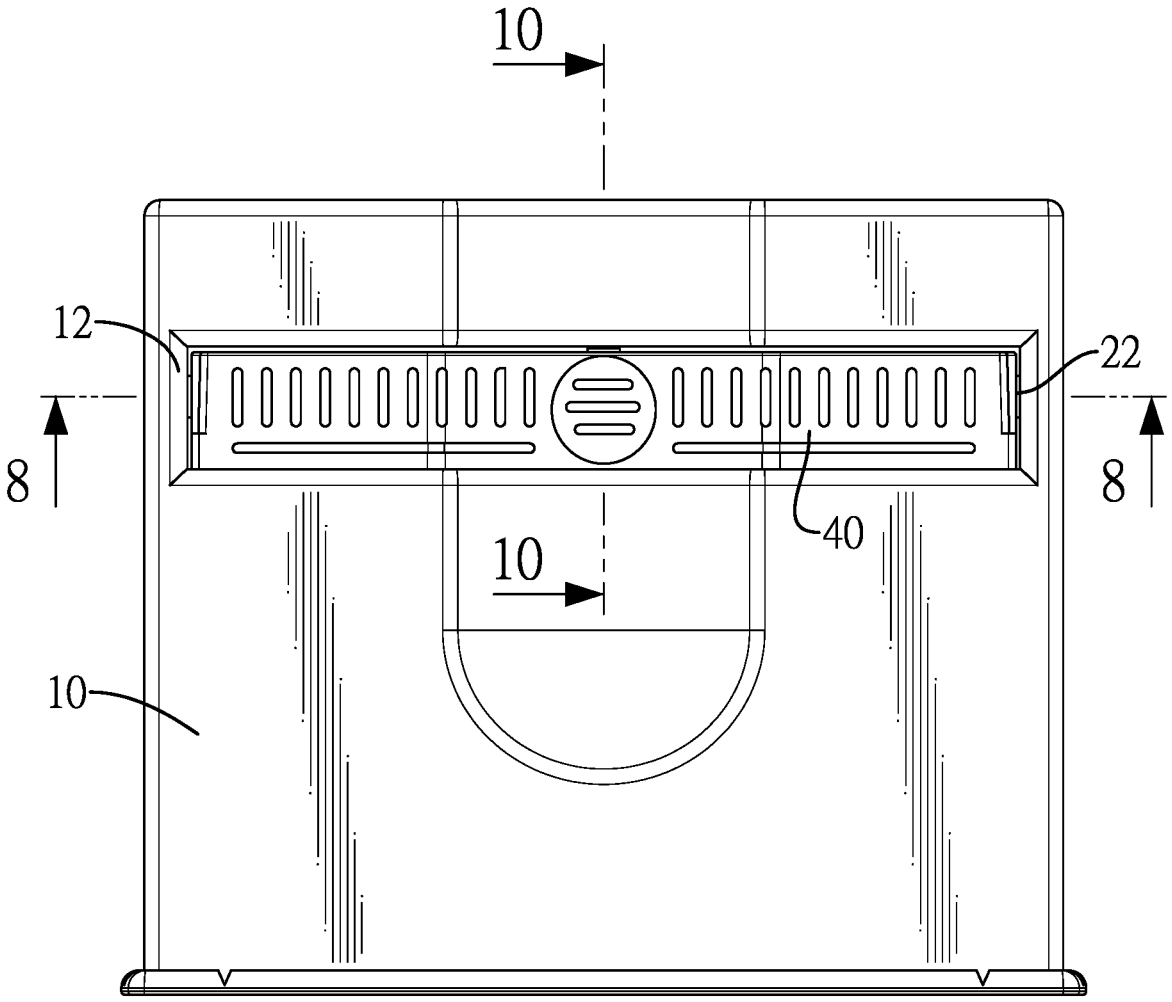
FIG. 7 is a front side view of the positioning device in FIG. 6.

With reference to FIGS. 1 to 3, a positioning device for an ink pad container in accordance with the present invention has a body 10 and two elastic sheets 20.

The body 10 has a receiving space 11, a front side surface, a rear side surface, two lateral side surfaces, a front opening 12, a rear opening 13, and two through grooves 14. The receiving space 11 is formed in the body 10. The lateral side surfaces are opposite to each other. The front opening 12 is formed through the front side surface of the body 10 and communicates with the receiving space 11. The rear opening 13 is formed through the rear side surface of the body 10 and communicates with the receiving space 11. The two through grooves 14 are respectively formed through the two lateral side surfaces of the body 10 and both communicate with the receiving space 11.

The elastic sheets 20 are respectively formed on the two lateral side surfaces of the body 10. Each one of the two elastic sheets 20 has an arm 21 and a positioning protrusion 22. The arm 21 is formed on a corresponding one of the two lateral side surfaces of the body 10, is inserted into a corresponding one of the two through grooves 14, and has an inner side surface. The positioning protrusion 22 is formed on the inner side surface of the arm 21 and is inserted into the receiving space 11 of the body 10.

With reference to FIG. 3, the body 10 has an inner top surface and a guiding groove 15. The guiding groove 15 is formed on the inner top surface of the body 10 and has a front end and a rear end. The front end of the guiding groove 15 faces the front opening 12 of the body 10. The rear end of the guiding groove 15 faces the rear opening 13 of the body 10. With reference to FIG. 1, the body 10 has two longitudinal grooves 16. The two longitudinal grooves 16 are respectively formed through the two lateral side surfaces of the body 10 and are located below the two through grooves 14 respectively.

With reference to FIGS. 4 to 7, the positioning device is disposed in a housing 31 of a stamp 30 for an ink pad container 40 to be inserted therein. The ink pad container 40 has two outer surfaces and two positioning members. The outer surfaces of the ink pad container 40 are opposite to each other. The two positioning members of the ink pad container 40 are respectively disposed on the two outer surfaces of the ink pad container 40. Each one of the two positioning members of the ink pad container 40 has two longitudinal ribs 41 and a positioning groove 42. The longitudinal ribs 41 are formed on and protrude out of the outer surface of the ink pad container 40. The positioning groove 42 is formed on the outer surface of the ink pad container 40 and is located between the two longitudinal ribs 41.

Figure 8:
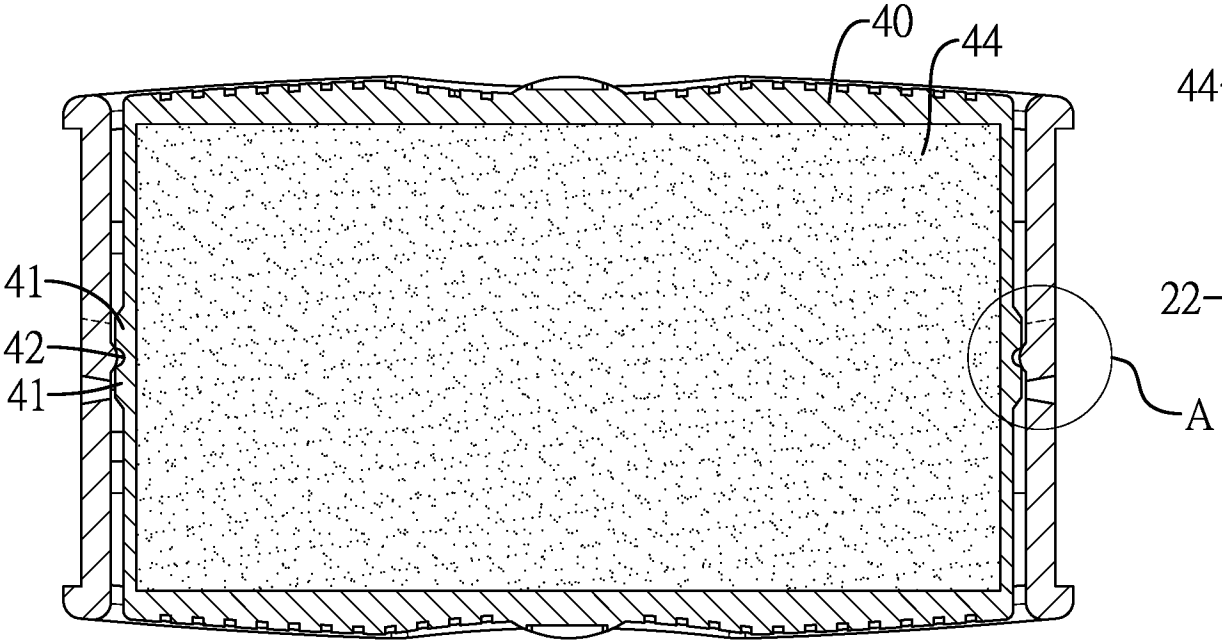
FIG. 8 is a cross sectional side view of the positioning device along line 8-8 in FIG. 7.
Figure 10:
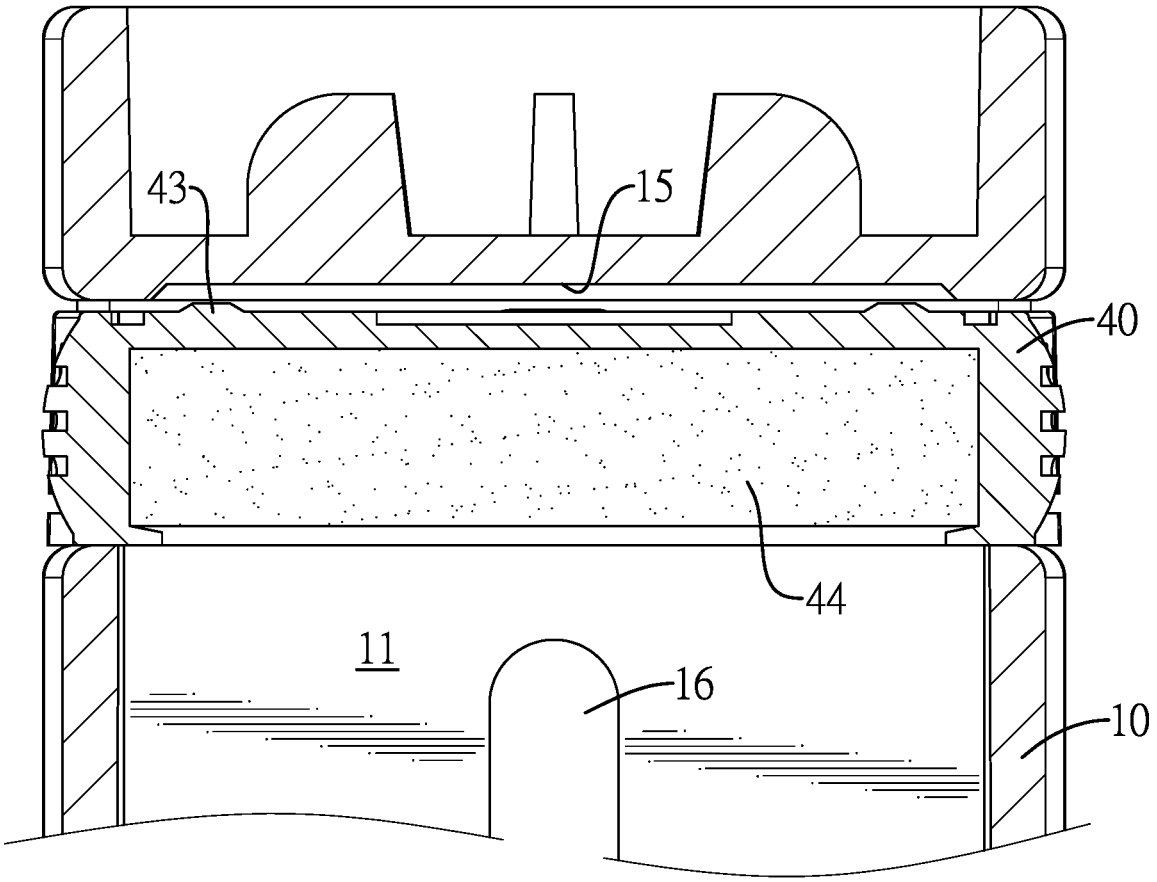
FIG. 10 is a cross sectional side view of the positioning device along line 10-10 in FIG. 7.
Figure 12:
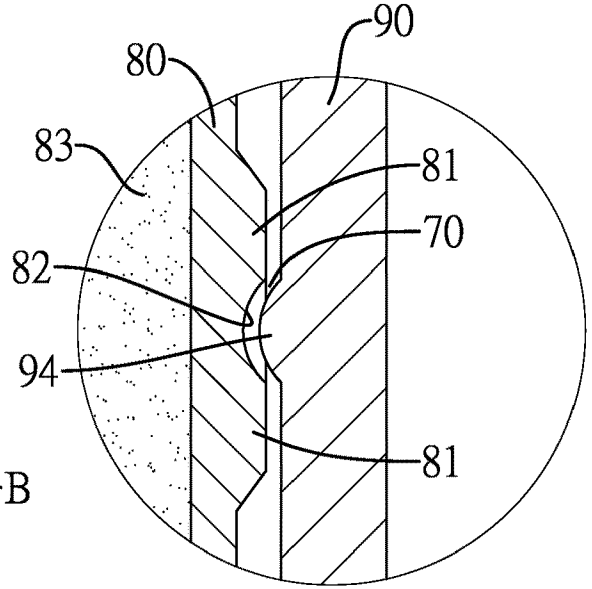
FIG. 12 PRIOR ART
FIG. 12 is an enlarged cross sectional side view of the conventional positioning device in FIG. 11.
Figure 11:
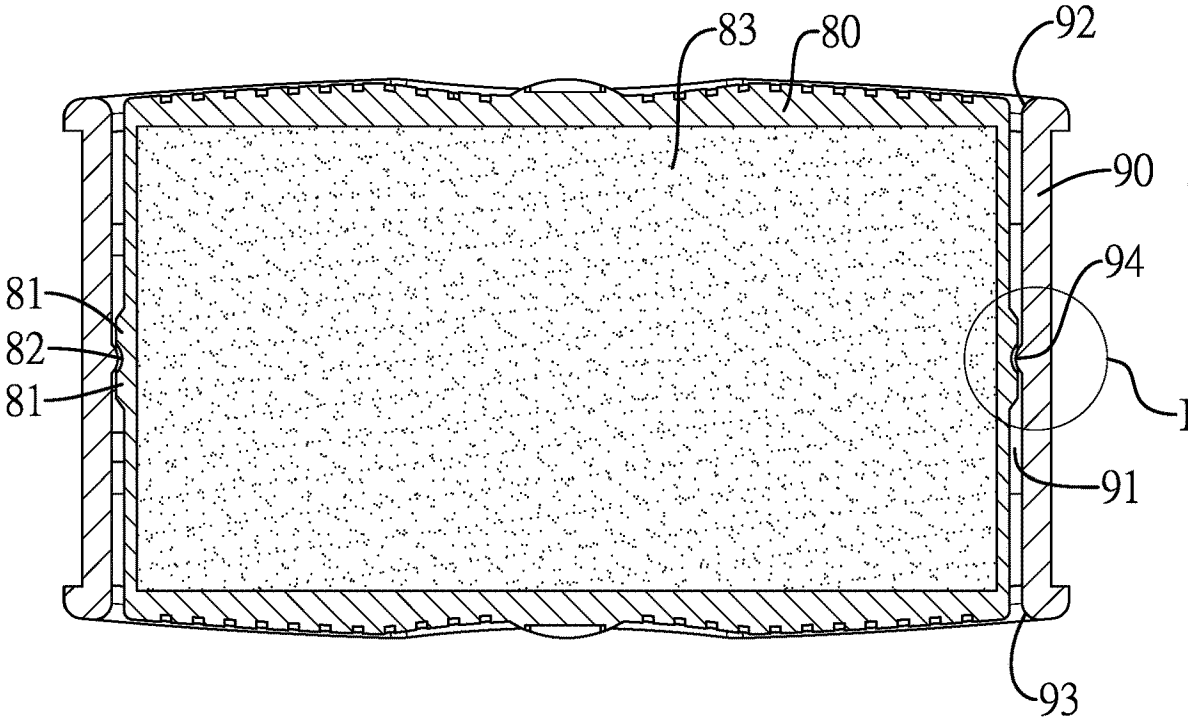
FIG. 11 PRIOR ART
FIG. 11 is a cross sectional side view of a conventional positioning device in accordance with the prior art combined with an ink pad container.

With reference to FIG. 8, the ink pad container 40 can be inserted into the receiving space 11 of the body 10 via the front opening 12 or the rear opening 13 of the body 10. The ink pad container 40 is inserted between the two elastic sheets 20. The arms 21 of the two elastic sheets 20 are pushed by the passing longitudinal ribs 41 for moving outwardly. The positioning protrusions 22 can be respectively inserted into the positioning grooves 42 by the rebounds of the elastic sheets 20. Each one of the positioning protrusions 22 abuts against the two adjacent longitudinal ribs 41. Therefore, the two elastic sheets 20 abut against the ink pad container 40 for clipping the ink pad container 40 to position the ink pad container 40.

When the two longitudinal ribs 41 of each one of the positioning members are close to a corresponding one of the two elastic sheets 20, one of the two longitudinal ribs 41 passes through the positioning protrusion 22 of the corresponding elastic sheet 20 and pushes the positioning protrusion 22 and the arm 21 of the corresponding elastic sheet 20 outwardly. Then, the positioning protrusion 22 is inserted into the corresponding positioning groove 42 and abuts against the two adjacent longitudinal ribs 41.

For pressing the ink pad container 40 to move out of the body 10, the longitudinal ribs 41 of the ink pad container 40 are passed through the positioning protrusions 22 of the two elastic sheets 20. The positioning protrusions 22 are outwardly pushed by the longitudinal ribs 41 due to the arms 21. The longitudinal ribs 41 can pass through the positioning protrusions 22 smoothly. The ink pad container 40 is easy to be pressed out of the body 10.

Figure 9:
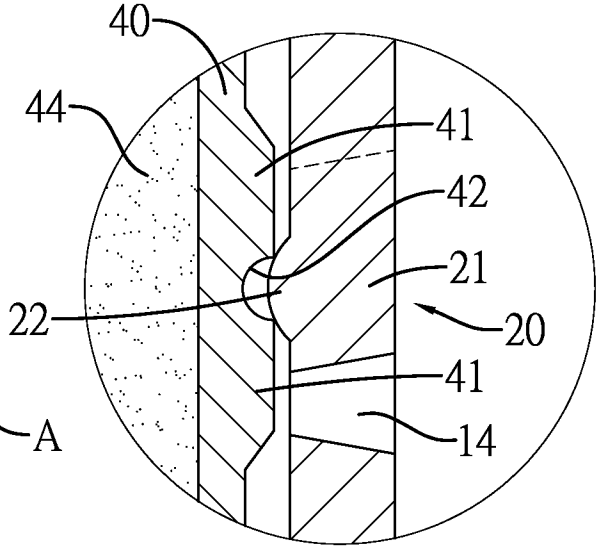
FIG. 9 is an enlarged cross sectional side view of the positioning device in FIG. 8.

With reference to FIG. 9, the ink pad container 40 has a top surface and multiple guiding elements 43. The guiding elements 43 are disposed on the top surface of the ink pad container 40. When the ink pad container 40 is inserted into the body 10, the guiding elements 43 can be guided by the guiding groove 15, and the ink pad container 40 can be easily inserted into the body 10.

Accordingly, each one of the positioning protrusions 22 abuts against the two adjacent longitudinal ribs 41 of the ink pad container 40 by a resilience provided by the arm 21 of the corresponding one of the two elastic sheets 20. Even though the ink pad containers 40 inserted into the body 10 have slight differences in size, the positions of the two positioning protrusions 20 can be suitably adjusted by the arms 21 for abutting against the longitudinal ribs 41 of the ink pad container 40. The ink pad container 40 can be positioned in the body 10 securely. After the ink pad container 40 is positioned in the body 10, the ink pad container 40 does not have a moveable allowance to move. Therefore, the ink pad container 40 can be firmly positioned in the body 10. A printing surface of the stamp 30 can be pressed on an ink pad 44 in the ink pad container 40 for completely staining ink in the ink pad 44 to make a clear stamped pattern.

The ink pad container 40 is positioned in the body 10 by the two elastic sheets 20. The two elastic sheets 20 have the resiliences. Requirement for the size accuracy of the positioning device and the size accuracy of the ink pad container 40 can be less strict. The tolerance allowances of the positioning device and the ink pad container 40 are increased, and the positioning stability of the ink pad container 40 is increased simultaneously. The ink pad container 40 is easy to be disposed into and pushed out of the positioning device. Therefore, the positioning device can simultaneously satisfy the requirements for ease in assembly and for the positioning stability.

What is claimed is:

1. A positioning device for an ink pad container comprising:

a body having a receiving space formed in the body;

a front side surface;

a rear side surface;

two lateral side surfaces opposite to each other;

a front opening formed through the front side surface of the body and communicating with the receiving space;

a rear opening formed through the rear side surface of the body and communicating with the receiving space; and two through grooves respectively formed through the two lateral side surfaces of the body and both communicating with the receiving space; and two elastic sheets respectively formed on the two lateral side surfaces of the body, and each one of the two elastic sheets having an arm formed on a corresponding one of the two lateral side surfaces of the body, inserted into a corresponding one of the two through grooves, and having an inner side surface; and a positioning protrusion formed on the inner side surface of the arm and inserted into the receiving space of the body.

2. The positioning device as claimed in claim 1, wherein the body has an inner top surface and a guiding groove, the guiding groove is formed on the inner top surface of the body and has a front end and a rear end, the front end of the guiding groove faces the front opening of the body, and the rear end of the guiding groove faces the rear opening of the body.

3. The positioning device as claimed in claim 1, wherein the body has two longitudinal grooves, and the two longitudinal grooves are respectively formed through the two lateral side surfaces of the body and are respectively located below the two through grooves.

4. The positioning device as claimed in claim 2, wherein the body has two longitudinal grooves, and the two longitudinal grooves are respectively formed through the two lateral side surfaces of the body and are respectively located below the two through grooves.

* * * * *